US005779160A

United States Patent [19]

Rucker

[11] Patent Number: 5,779,160

[45] Date of Patent: Jul. 14, 1998

[54] LOW-FLOW STATOR AND METHOD

[75] Inventor: David L. Rucker, Shell Beach, Calif.

[73] Assignee: Cloud Company, Inc., San Luis Obispo, Calif.

[21] Appl. No.: 696,449

[22] Filed: Aug. 13, 1996

[51] Int. Cl.[6] ..... B05B 1/34

[52] U.S. Cl. ..... 239/466; 239/463

[58] Field of Search ..... 239/461, 463, 239/466, 227, 229, 222.17, 222.19

[56] References Cited

U.S. PATENT DOCUMENTS

| | | | |
|---|---|---|---|
| 2,105,458 | 1/1938 | Johnson | 239/227 |
| 2,120,784 | 6/1938 | Howald | 239/227 |
| 2,322,271 | 6/1943 | Bagley | 239/227 |
| 2,917,243 | 12/1959 | Lione | 239/227 |
| 2,947,482 | 8/1960 | Lione | 239/227 |
| 3,275,241 | 9/1966 | Saad | 239/227 |
| 3,458,136 | 7/1969 | Belaieff | 239/227 |
| 3,464,632 | 9/1969 | Bristow | 239/227 |
| 3,637,138 | 1/1972 | Rucker | 239/227 |
| 3,697,190 | 10/1972 | Haentjens | 415/73 |
| 3,747,854 | 7/1973 | Anderson | 239/227 |
| 3,902,670 | 9/1975 | Koller et al. | 239/227 |
| 4,316,580 | 2/1982 | Bodai | 239/466 |
| 4,664,720 | 5/1987 | Rucker | 239/227 X |
| 5,012,976 | 5/1991 | Loberg | 239/227 |
| 5,462,227 | 10/1995 | Ping | 239/227 |

FOREIGN PATENT DOCUMENTS

| | | | |
|---|---|---|---|
| 1037259 | 7/1966 | United Kingdom | 239/227 |

OTHER PUBLICATIONS

Cloud Company, San Luis Obispo, CA. Literature re models 360, 700, 750 and 180 tank cleaning systems. Copyright 1990, 1991, 1992.

*Primary Examiner*—Lesley D. Morris

*Attorney, Agent, or Firm*—Townsend and Townsend and Crew LLP

[57] ABSTRACT

A low-flow stator (4), used upstream of a rotor (27) of a tank cleaning machine, includes a body (6) having a plurality of generally helical passageways (38) extending from a front surface (10) of the body to a rear surface (12) of the body. Each passageway has an entrance (40) and an exit (42), the exit being completely circumferentially offset from its corresponding entrance.

30 Claims, 4 Drawing Sheets

LOW-FLOW STATOR AND METHOD

BACKGROUND OF THE INVENTION

Tank cleaning machines are used to clean the interior surfaces of a variety of containers ranging, for example, from small beer barrels to jumbo railroad tank cars. Conventional rotary tank cleaning machines typically look something like heavy-duty lawn sprinklers. Conventional tank cleaning machines typically have a nozzle assembly with two or more nozzles which rotate about a first axis while the entire nozzle assembly rotates about a second axis oriented transverse to the first axis.

The power for driving the nozzles can be generated by the flow of liquid, typically water and cleaning compounds, through the tank cleaning machine or by a separate power source, such as compressed air. The liquid-powered tank cleaning machines are often preferred because they eliminate the need for a separate source of driving power. To generate the power necessary to drive the tank cleaning machine, the liquid passing through the inlet of the tank cleaning machine typically passes a stator which directs the liquid against the vanes of a rotor; this causes the rotor to rotate thus creating the necessary power for operation of the tank cleaning machine. Conventional tank cleaning machines are shown in U.S. Pat. No. 2,120,784 to Howald; 3,902,670 to Koller; and 4,664,720 to Rucker, the disclosures of which are incorporated by reference.

SUMMARY OF THE INVENTION

The present invention is directed to a low-flow stator and method for directing liquid to a rotor. The low-flow stator permits the reliable operation of the tank cleaning machine at lower flow rates than possible with conventional stators.

The low-flow stator, used upstream of a rotor of a tank cleaning machine, includes a body having a plurality of generally helical passageways extending from a front surface of the body to a rear surface of the body. Each passageway has an entrance and an exit, the exit being completely circumferentially offset from its corresponding entrance.

One recognized problem with conventional tank cleaning machines is how to reduce total liquid use without sacrificing cleaning effectiveness. Several factors come into play when trying to reduce the total liquid use of a tank cleaning machine. As a general rule, as flow through the machine decreases, either due to restriction of the nozzles or limitations in the pump feeding the machine, the difficulty of getting the machine to operate reliably increases. Also, as the time required for a tank cleaning machine to complete a full cycle increases, the total liquid consumed during the cleaning cycle also increases.

One of the key features of the invention is that it permits the reliable operation of a tank cleaning machine at reduced flow rates and for reduced cycle times. For example, the lowest flow at which a conventional tank cleaning machine was able to perform reliably, which is a critical factor, was 36 gallons per minute (at 120 psi). This example required a starting pressure of about 40 psi; the cycle time was approximately 36 minutes. Further modifications to this conventional machine to try to reduce the total flow, such as using smaller nozzles and various internal configurations to get the flow and cycle time reduced, were met with either the machine not turning or the machine running for a very short period of time. However, by replacing the conventional stator with a low-flow stator made according to the invention and using either a modified or a conventional low-flow rotor, the same machine was consistently run at flows as low as 18 gallons per minute (at 120 psi) with cycle times of about 13 to 16 minutes and with a starting pressure in the 5 to 10 psi range. This low starting pressure is a great indication of the power generated by the low-flow stator.

One of the advantages of the invention is that it can be used to replace conventional stators for existing tank cleaning machines in a retrofit operation. Providing the low-flow stator with a conventional low-flow rotor permits conventional tank cleaning machines to be easily and simply modified to work in a satisfactory manner at reduced flow rates and for decreased cycle times to provide substantial savings in the amount of liquid used.

One of the aspects of the invention is that the passageways are preferably equally spaced to help ensure that the rotor shaft remains in balance. Therefore, two or more evenly spaced passageways are generally preferred. It may also be possible to provide passageways which are not evenly spaced but still create a force distribution such that the rotor remains in balance.

The front surface of the body is preferably conical. While a conical front surface having a 45° angle is presently preferred, other cone angles and other outwardly extending configurations for front surface could be used as well. For example, the front surface could be curved in both circumferential and axial directions as opposed to only a circumferential direction when the front surface is a conical surface. Also, the front surface need not be a surface of revolution but could, for example, have flat segments or dished portions for the passageways.

It is desired that the passageways be formed to deliver the liquid to the rotor at the appropriate angle with the least pressure drop. It is therefore preferred that the passageways be smooth helical passageways. Passageways may, however, be made of two or more straight and/or curved segments. When used in this application, generally helical passageways includes both true helical passageways and passageways which are not helical but approximate a helical path.

In the preferred embodiment the passageways have a smaller cross-sectional area at their exits than at their entrances so to speed up the flow at the exit. This can be adjusted, depending on circumstances, so that, for example, the cross-sectional area of the passageway remains the same along its entire length or increases at the exit as opposed to the entrance. In the preferred embodiment the passageways remain at a generally constant radius from the axis of the body. The passageways could be formed so that the radial distance from the axis changes from, for example, a smaller radial distance at the entrance to a larger radial distance at the exit.

Other features and advantages of the invention will appear from the following description in which the preferred embodiment has been set forth in detail in conjunction with the accompanying drawings.

DESCRIPTION OF THE PREFERRED EMBODIMENTS

Figure 1:
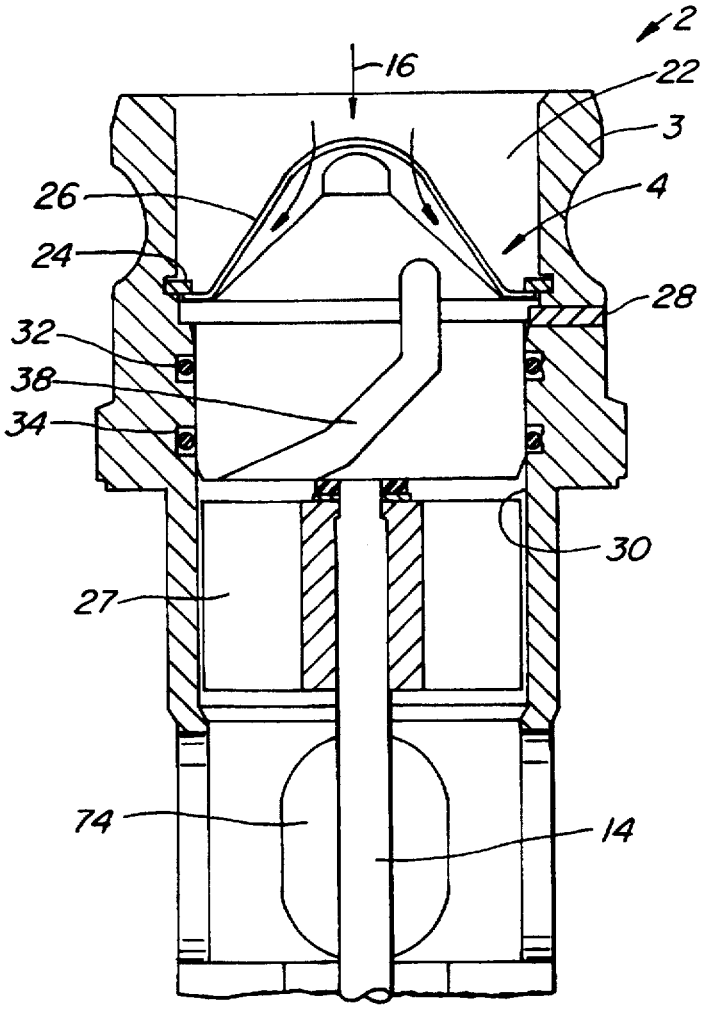
FIG. 1 is a somewhat simplified cross-sectional view showing an inlet portion of a tank cleaning machine incorporating a low-flow stator made according to the invention.

FIG. 1 illustrates an inlet portion 2 of a tank cleaning machine including a hollow main body 3 housing a low-flow stator 4 made according to the invention. Low-flow stator 4 includes body 6 having a generally cylindrical circumferential sidewall 8 connecting a front, mostly conical front surface 10 and a bottom surface 12. Body 6 has an axis 14 coaxial with a flow direction 16. Body 6 also has an annular lip 18, see FIG. 2, extending radially outwardly from the periphery 20 of front surface 10. Annular lip 18 permits body 6 of low-flow stator 4 to be secured within the inlet 22 of main body 3 through the use of a snap ring 24 upstream of a rotor 27. A pin 28 passing through main body 3 is used to keep stator 4 from rotating within inlet 22. Snap ring 24 also secures a strainer 26 near but spaced apart from surface 10; strainer 26 is used to keep debris out of the gearbox of the tank cleaning machine.

A pair of O-rings 32 are housed within appropriately sized grooves 34 formed in an interior wall 30 of main body 3 so to provide a seal between wall 30 and sidewall 8 of body 6. This helps to prevent the bypass of liquid around body 6. If desired a shroud or sleeve 28 (not shown) may be positioned between interior wall 30 and sidewall 8 of body 6.

Body 6 has three evenly spaced passageways 38. Each passageway 38 extends from an entrance 40 formed adjacent to periphery 20 to an exit 42 formed in bottom surface 12. Passageway 38 narrows somewhat from entrance 40 to exit 42 so that liquid flowing along the passageway speeds up as it leaves exit 42.

Each passageway 38 is a generally helical passageway. In the embodiment shown in FIGS. 1–5, passageway 38 includes three straight segments 44, 46, 48. First segment 44 is generally parallel to axis 14 while second and third segments 46, 48 are at angles 50, 52 relative to lines oriented parallel to axis 14. Angle 52 is the exit angle for the liquid passing through passageways 38 and preferably ranges from about 5° to about 85°. In the disclosed embodiment exit angle 52 is about 65°. Exit angle 52 can be varied to affect cycle times at various flow rates; other factors affecting cycle times and flow rates include the configuration and size of rotor 27, the gear ratio, such as 650/1 or 273/1, and the nozzle opening size, such as 0.090 to 0.375 inch diameter. In the preferred embodiment, entrance 40 has a depth 56 (see FIG. 3) of about 0.350 inch while exit 42 has a depth 58 of about 0.250 inch. This creates a reduction in the cross-sectional area at entrance 40 and exit 42 of about 29% to achieve a desired increase in the speed of movement of the liquid through passageway 38.

As used in this application, generally helical passageways includes passageways 38 which are not truly helical but approximate a helical path. For example, generally helical passageways may have other smoothly curving or segmented curving shapes or, as shown in the disclosed embodiment, may be made of one or more straight sections. Combinations of curved and straight segments can also be used. In the disclosed embodiment the straight sections were created due to limitations of the equipment used to make stator 4.

It has been found that making front surface 10 at entrance angle 60 of about 30° to 60°, and preferably 45°, to a line parallel to axis 14 is desirable. It is believed that angles greater than about 60° may create excessive turbulence in inlet 22, thus reducing efficiency.

Figure 2:
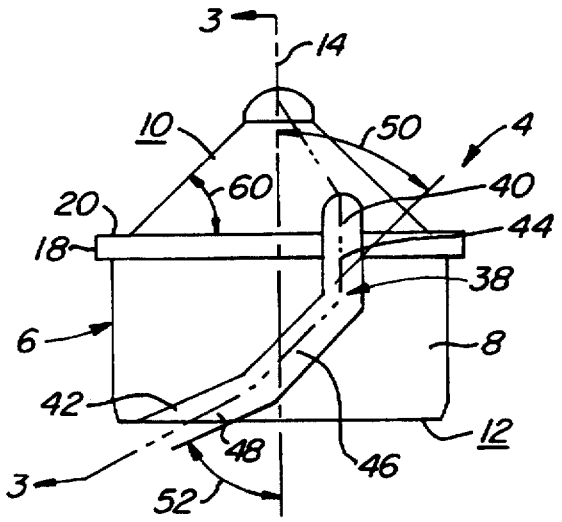
FIG. 2 is a side view of the stator of FIG. 1.
Figure 3:
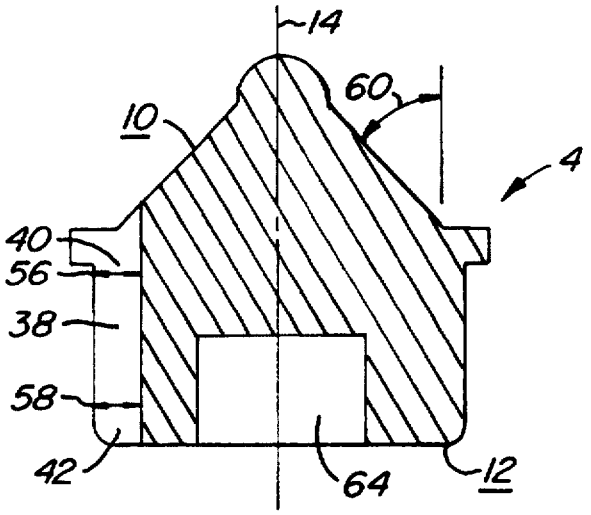
FIG. 3 is a cross-sectional view taken along line 3—3 of FIG. 2.
Figure 4:
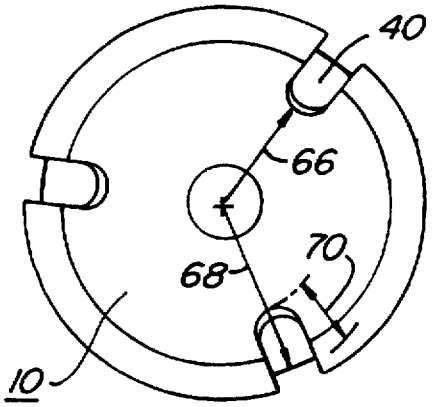
FIG. 4 is top plan view of the low-flow stator of FIG. 2 with a portion broken away to show one of the three passageways.
Figure 5:
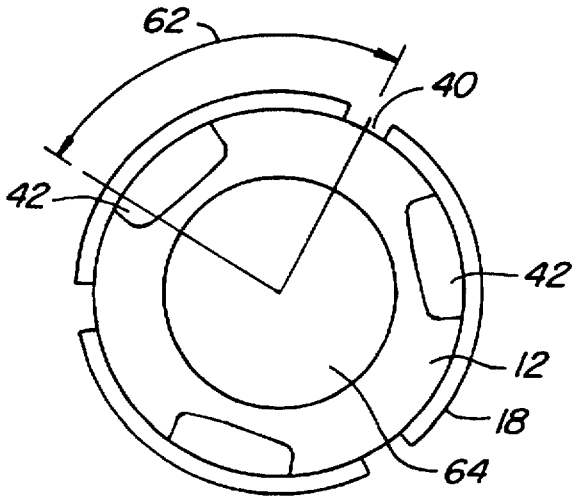
FIG. 5 is a bottom plan view of the stator of FIG. 2.

Entrance 40 and exit 42 are completely circumferentially offset from one another so that no portion of exit 42 is axially aligned with its associated entrance 40. This is shown in FIGS. 2 and 4. The circumferential offset angle 62, see FIG. 5, between entrance 40 and exit 42 is preferably about 5° to 170° or more; in the preferred embodiment angle 62 is about 85°.

Body 6 can be made of various materials depending on the particular circumstances and situations. For example, body 6 may be made of a metal, such as aluminum, stainless steel or brass, or of plastic, such as acetyl, nylon, or PTFE. Front surface 10 is shown to be a plain cone. Front surface 10 could be other shapes extending from periphery 20 axially away from sidewall 8 and radially inwardly towards axis 14. For example, surface 10 could be inwardly or outwardly bowed, could have steps or other interruptions, could be made from two or more surfaces which curve in a rotary direction but not in an axial direction or which curve in both rotary and axial directions. The latter could occur if surface 10 or an end portion of surface 10 were parabolic. Bottom surface 12 has a recessed region 64. This recessed region is to allow for clearance at the top of the rotor shaft and/or clearance for any bearing carriers and to reduce the weight of the stator.

Each entrance 40 has an inner diameter 66 and an outer diameter 68 which define an annular surface area 70. See FIG. 4. The total cross-sectional area of entrances 40 is substantially less than, preferably no more than about 10% of, annular surface area 70. In the disclosed embodiment the total area of all three entrances 40 is no more than about 30% of annular surface area 70.

Figure 6A:
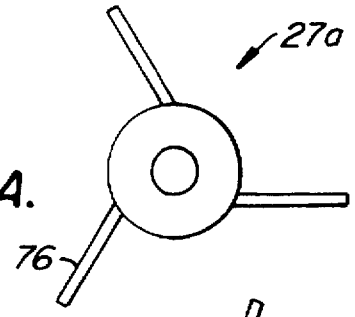
FIG. 6A–6C are simplified top plan views of rotors having different numbers of blades.
Figure 6B:
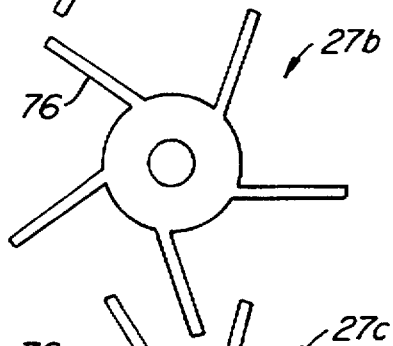
Figure 6C:
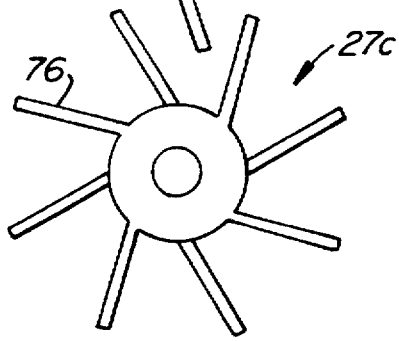
Figure 7A:
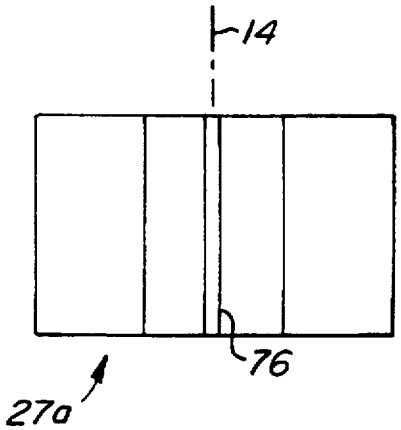
FIG. 7A and 7B are side views of the rotor of FIG. 6A showing blades having straight and curved profiles.
Figure 7B:
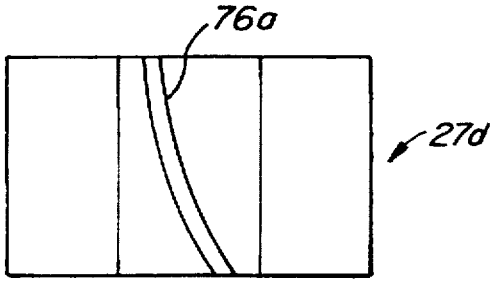
Figure 7C:
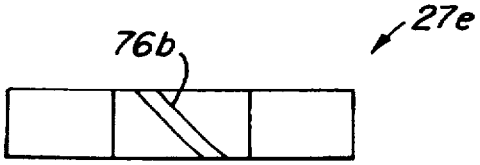
FIG. 7C illustrates a rotor similar to that of FIG. 7A but having a reduced height and having the blades angled to the axis of rotation of the rotor.

FIG. 6A–6C illustrate three different rotors 27A, 27B, and 27C having three, five, and eight blades 76, respectively. FIG. 7A illustrates a side view of the rotors 27A of FIG. 6A showing how blade 76 extends parallel to axis 14. FIG. 7B illustrates an alternative embodiment to that of FIG. 7A in which blades 76A are curved as opposed to the straight blades 76 of FIG. 7A. FIG. 7C illustrates a straight blade 76B oriented at a 45° angle to axis 13, the height of rotor 27E being about one-third that of rotor 27A. These and other various configurations for rotors 27 can be employed according to the particular service requirements encountered.

Figure 8:
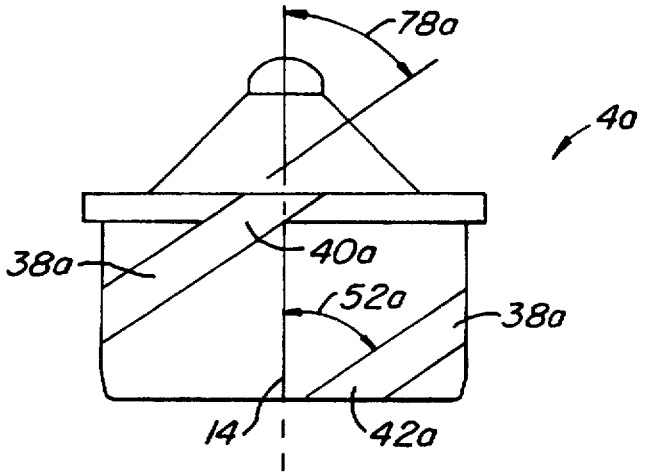
FIGS. 8–10 illustrate side views of alternative embodiments of the stator of FIG. 2.
Figure 9:
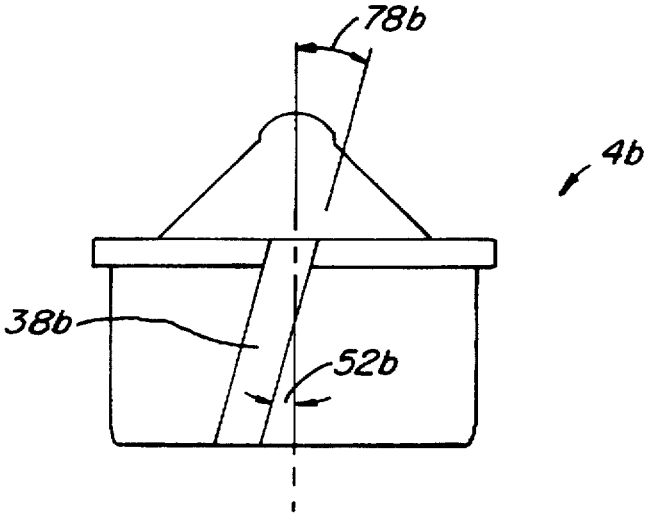
Figure 10:
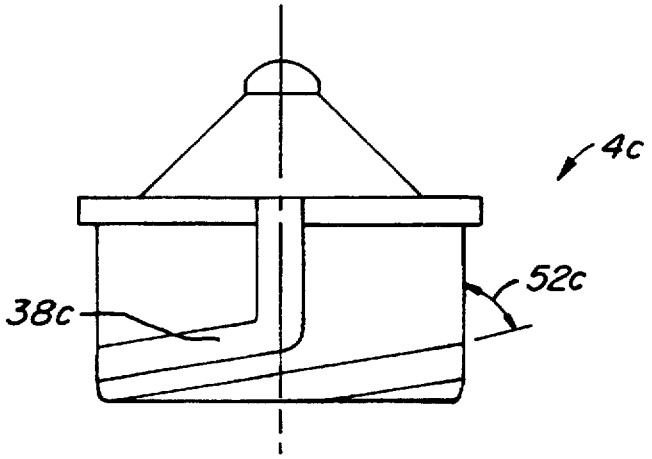

FIGS. 8–10 illustrate three different alternative embodiments of stator 4. Stator 4A of FIG. 8 illustrates a passageway 38A having a constant angular orientation relative to axis 14. Passageway 38A has an entrance angle 78A of about 55° in this embodiment. In the embodiment of FIG. 2 the entrance angle, which is measured relative to a line parallel to axis 14, is 0°. In this case, exit angle 52A is also about 55°. The embodiment of FIG. 9 entrance angle 78B is equal to exit angles 52B, and is equal to about 15°. In the embodiment shown in FIG. 10, the entrance angle is 0° but the exit angle 52C is about 80° from a line parallel to axis 14. The choice of the different entrance and exit angles depend upon operating requirements, including the following factors:

flow rate, cycle time, operating pressure, number of nozzles, nozzle size, gear ratio.

In use, low-flow stator 4 finds particular utility when used to replace a conventional stator at an inlet portion of a tank cleaning machine. In the preferred embodiment this is achieved by mounting body 6, with sleeve 28 mounted about sidewall 8, into inlet 22 and securing body 6 and strainer 26 therewith by snap ring 24. Liquid flowing through inlet 22 passes downwardly along front surface 10 and enters entrances 40 of passageways 38. This liquid then passes along each passageway 38 in a generally helical path and exits passageway 38 at exit 42 where it is directed towards rotor 27. This causes rotor 27 to rotate thus turning a rotor shaft 72 (see FIG. 1), which causes the appropriate drive train to move causing the desired motion of the tank cleaning machine. The liquid then passes through exit ports 74 and on to the rotating nozzles (not shown).

Modification and variation can be made to the disclosed embodiment without departing from the subject of the invention as defined in the following claims. For example, sidewall 8 need not be generally cylindrical but could be, for example, an irregular polygon, generally hexagonal or a mixture of curved and flat surfaces.

What is claimed is:

1. A low-flow stator for use upstream of a rotor of a tank cleaning machine comprising:

a body having a front surface, a rear surface and a circumferential sidewall coupling the front and rear surfaces, said body defining an axis passing through the front and rear surfaces;

said front surface having a periphery, at least a portion of said front surface extending from said periphery axially away from the sidewall and radially inwardly;

said body comprising a plurality of passageways fluidly coupling the front and rear surfaces, each said passageway extending from an entrance to an exit;

each said passageway defining a generally helical flow path from said entrance to said exit so that a fluid passing along said flow path leaves said exit of said passageway at an exit angle relative to a line passing through said exit and oriented parallel to said axis; and each said exit being completely circumferentially offset from its corresponding entrance.

2. The stator according to claim 1 wherein said front surface portion is a conical surface.

3. The stator according to claim 2 wherein said front surface portion defines an angle of about 30° to 60° to said axis.

4. The stator according to claim 2 wherein said front surface portion defines an angle of about 45° to said axis.

5. The stator according to claim 1 wherein said circumferential sidewall is a generally cylindrical surface.

6. The stator according to claim 5 wherein said periphery is generally circular.

7. The stator according to claim 1 wherein the entrances and exits are adjacent to the front and rear surfaces, respectively.

8. The stator according to claim 1 wherein said body comprises three said passageways.

9. The stator according to claim 1 wherein said generally helical flow path of at least one said passageway includes an axially-extending segment.

10. The stator according to claim 1 wherein said generally helical flow path of at least one said passageway includes a series of straight segments.

11. The stator according to claim 1 wherein said body is made of a metal.

12. The stator according to claim 1 wherein said exit angle is about 5° to 85°.

13. The stator according to claim 1 wherein said exit angle is about 65°.

14. The stator according to claim 1 wherein said circumferential offset is about 5° to 170°.

15. The stator according to claim 1 wherein said circumferential offset is about 85°.

16. The stator according to claim 1 wherein said passageways are equally-spaced about said body.

17. The stator according to claim 1 further comprising a sleeve mounted adjacent to said sidewall.

18. A stator according to claim 1 wherein the entrance of each of said plurality of passageways is completely circumferentially offset from the entrance of each other of said passageways.

19. A low-flow stator for use upstream of a rotor of a tank cleaning machine comprising:

a body having a front surface, a rear surface and a circumferential sidewall coupling the front and rear surfaces, said body defining an axis passing through the front and rear surfaces;

said front surface having a periphery, at least a portion of said front surface extending from said periphery axially away from the sidewall and radially inwardly;

said body comprising a plurality of passageways fluidly coupling the front and rear surfaces, each said passageway extending from an entrance to an exit;

each said passageway defining a generally helical flow path from said entrance to said exit so that a fluid passing along said flow path leaves said exit of said passageway at an exit angle relative to a line passing through said exit and oriented parallel to said axis;

each said exit being completely circumferentially offset from its corresponding entrance; and wherein said passageways have an inner diameter and an outer diameter, said inner and outer diameters defining an annular surface area, said entrances of said passageways having cross-sectional areas, the sum of the cross-sectional areas of said entrances of said passageways is no more than about 30° of said annular surface area.

20. A low-flow stator for use upstream of a rotor of a tank cleaning machine comprising:

a body having a front surface, a rear surface and a circumferential sidewall coupling the front and rear surfaces, said body defining an axis passing through the front and rear surfaces;

said front surface having a periphery, at least a portion of said front surface extending from said periphery axially away from the sidewall and radially inwardly;

said body comprising a plurality of passageways fluidly coupling the front and rear surfaces, each said passageway extending from an entrance to an exit;

each said passageway defining a generally helical flow path from said entrance to said exit so that a fluid passing along said flow path leaves said exit of said passageway at an exit angle relative to a line passing through said exit and oriented parallel to said axis;

each said exit being completely circumferentially offset from its corresponding entrance; and wherein cross-sectional areas of said entrances and exits of said passageways are different.

21. A low-flow stator for use upstream of a rotor of a tank cleaning machine comprising:

a body having a front surface, a rear surface and a circumferential sidewall coupling the front and rear surfaces, said body defining an axis passing through the front and rear surfaces;

said front surface having a periphery, at least a portion of said front surface extending from said periphery axially away from the sidewall and radially inwardly;

said body comprising a plurality of passageways fluidly coupling the front and rear surfaces, each said passageway extending from an entrance to an exit;

each said passageway defining a generally helical flow path from said entrance to said exit so that a fluid passing along said flow path leaves said exit of said passageway at an exit angle relative to a line passing through said exit and oriented parallel to said axis;

each said exit being completely circumferentially offset from its corresponding entrance; and wherein cross-sectional areas of passageways are larger at said entrances than at said exits.

22. An improved tank cleaning machine of the type having a stator upstream of a rotor, the improvement comprising:

a stator body having a front surface, a rear surface and a circumferential sidewall coupling the front and rear surfaces, said body defining an axis passing through the front and rear surfaces;

said front surface having a periphery, said front surface extending from said periphery axially away from the sidewall and radially inwardly;

said body comprising a plurality of passageways, each said passageway extending from an entrance adjacent the front surface to an exit adjacent the rear surface;

each said passageway defining a generally helical flow path from said entrance to said exit so that a fluid passing along said flow path leaves said exit of said passageway at an exit angle of about 5° to 85° relative to a line passing through said exit and oriented parallel to said axis;

each said exit being completely circumferentially offset from its corresponding entrance by an offset angle of about 5° to 170°; and said passageways having an inner diameter and an outer diameter, said inner and outer diameters defining an annular surface area, said entrances of said passageways having cross-sectional areas, the sum of the cross-sectional areas of said entrances of said passageways is no more than about 30% of said annular surface area.

23. A method for directing a liquid to a rotor of a tank cleaning machine, the liquid passing along a flow direction, comprising the following steps:

deflecting said liquid radially outwardly at an entrance angle to the flow direction;

flowing said liquid into a plurality of generally helical passageways, each said passageway having an entrance and an exit; and directing said liquid from each of said exits towards the rotor at an exit angle with each said completely circumferentially offset from its corresponding entrance.

24. The method according to claim 23 wherein said deflecting step is carried out with an entrance angle of about 0° to 45°.

25. The method according to claim 23 wherein said flowing step is carried out by flowing said liquid into said generally helical passageways comprising a plurality of straight passageway segments.

26. The method according to claim 23 wherein the directing step is carried out with said exit angle about 5° to 85°.

27. The method according to claim 23 wherein said directing step is carried out with said exit angle about 65°.

28. The method according to claim 23 wherein said directing step is carried out with said exits being circumferentially offset from said corresponding entrances by an offset angle of about 5° to 170°.

29. The method according to claim 28 wherein said directing step is carried out with said offset angle being about 85°.

30. A method according to claim 23 wherein the flowing step occurs in passageways wherein the entrance of each of said plurality of passageways is completely circumferentially offset from the entrance of each other of said passageways.

* * * * *